US005528117A

United States Patent [19]

Buij et al.

[11] Patent Number: 5,528,117

[45] Date of Patent: Jun. 18, 1996

[54] ELECTRONIC LAMP BALLAST WITH DRIVING FREQUENCY BETWEEN LOAD RESONANT FREQUENCIES

[75] Inventors: Arnold W. Buij, Eindhoven; Paul R. Veldman, Oss; Pieter Van Zanten, Eindhoven, all of Netherlands

[73] Assignee: U.S. Philips Corporation, New York, N.Y.

[21] Appl. No.: 353,838

[22] Filed: Dec. 12, 1994

[30] Foreign Application Priority Data

Dec. 13, 1993 [BE] Belgium ..... 09301380

[51] Int. Cl.[6] ..... H05B 37/02

[52] U.S. Cl. ..... 315/224; 315/209 R; 315/244; 315/307; 315/324; 315/DIG. 7

[58] Field of Search ..... 315/209 R, 219, 315/224, 226, 227 R, 244, 283, 307, 324, DIG. 2, DIG. 5, DIG. 7

[56] References Cited

U.S. PATENT DOCUMENTS 4,538,093 8/1985 Melai ..... 315/219
5,068,571 11/1991 Schoofs ..... 315/DIG. 7 X
5,214,355 5/1993 Nilssen ..... 315/219
5,365,151 11/1994 Spiegel et al. ..... 315/209 R
5,414,327 5/1995 Reijnaerts ..... 315/219

FOREIGN PATENT DOCUMENTS 4039161 6/1992 Germany .

*Primary Examiner*—Robert Pascal
*Assistant Examiner*—Haissa Philogene
*Attorney, Agent, or Firm*—Brian J. Wieghaus

[57] ABSTRACT

The load circuits for the different lamps of a 2-lamp ballast are selected to have sufficiently different resonant frequencies so that the luminous fluxes of the two are different when the ballast operating frequency is at one of the resonant frequencies. The ballast is operated at a frequency between those two resonant frequencies. The circuit may include a device for measuring the ratio between the luminous fluxes of the two lamps, and the frequency control circuit is then responsive to that ratio.

4 Claims, 1 Drawing Sheet

ELECTRONIC LAMP BALLAST WITH DRIVING FREQUENCY BETWEEN LOAD RESONANT FREQUENCIES

BACKGROUND OF THE INVENTION

The invention relates to a circuit arrangement for operating at least two discharge lamps, comprising input terminals for connection to a supply voltage source, switching means coupled to the input terminals for generating a high-frequency voltage from a supply voltage delivered by the supply voltage source, a control circuit for generating a high-frequency signal for rendering the switching means conducting and non-conducting with high frequency, a first load branch provided with two ends which are coupled to the switching means, with first inductive means, with first capacitive means, and with terminals for accommodating a first discharge lamp, and a second load branch provided with two ends which are connected to the ends of the first load branch, with second inductive means, with second capacitive means, and with terminals for accommodating a second discharge lamp.

Such a circuit arrangement is known from German Patent Application DE 4039161 A1. Two discharge lamps in parallel load branches can be operated with the known circuit arrangement. A problem which arises in general in the operation of discharge lamps in parallel load branches is the control of the luminous fluxes of the discharge lamps. The luminous fluxes of the discharge lamps may, for example, differ strongly because the discharge lamps have different electrical properties. To counteract this problem, the known circuit arrangement is provided with a balance transformer. A first winding of this balance transformer forms part of the first load branch, and a second winding forms part of the second load branch. It is possible by means of this balance transformer to minimize a difference between the luminous fluxes of the two discharge lamps. The balance transformer, however, is a voluminous and comparatively expensive component. It was found in practice, moreover, that the balance transformer is less capable of eliminating a difference between the luminous fluxes in proportion as the luminous fluxes of the two discharge lamps are set for a lower value. As a result of this, a comparatively great difference between the luminous fluxes may be present in the case of low luminous flux set values of the discharge lamps in spite of the presence of the balance transformer. It was also found in practice that the lowest adjustable luminous fluxes of the two discharge lamps are strongly dependent on parasitic capacitances in the circuit arrangement.

SUMMARY OF THE INVENTION

It is an object of the invention to provide a circuit arrangement by which two discharge lamps in parallel load branches can be operated, and which is provided with comparatively simple means for controlling a ratio between the luminous flux of the first discharge lamp and the luminous flux of the second discharge lamp.

According to the invention, a circuit arrangement of the kind mentioned in the opening paragraph is for this purpose characterized in that the resonance frequency of the first load branch is different from the resonance frequency of the second load branch, in that the frequency of the high-frequency voltage is higher than the lower resonance frequency and lower than the higher resonance frequency, and in that the circuit arrangement is provided with means for adjusting the frequency of the high-frequency voltage.

The frequency of the currents flowing through the discharge lamps during lamp operation is equal to the frequency of the high-frequency voltage, referred to as operating frequency hereinafter. Since the operating frequency was chosen so as to lie between the two resonance frequencies, the impedance of the load branch with the higher resonance frequency decreases when the operating frequency increases. As a result, the current through the discharge lamp in this branch rises, so that also the luminous flux of the discharge lamp rises. The impedance of the load branch with the lower resonance frequency, moreover, increases with a rise in the operating frequency, and thus the current through the discharge lamp in this load branch will drop. Similarly, a decrease in the operating frequency leads to an increase in the luminous flux of the discharge lamp present in the load branch having the lower resonance frequency, and a decrease in the luminous flux of the discharge lamp present in the load branch having the higher resonance frequency. It is thus possible in a simple manner to control the ratio between the luminous fluxes of the two discharge lamps by means of a comparatively simple and inexpensive circuit arrangement, and to adjust the luminous fluxes of the discharge lamps, if so desired, to substantially equal values by means of the opening frequency. It was found that the ratio between the luminous fluxes of the discharge lamps, also when these luminous fluxes were comparatively low, were easily controlled by means of a circuit arrangement according to the invention. It was also found that the lowest adjustable luminous fluxes of the discharge lamps were not strongly dependent on parasitic capacitances.

A further interesting application of a circuit arrangement according to the invention lies in the operation of two discharge lamps which radiate light of different colour temperatures. It is possible in this case to adjust the color point of the light jointly radiated by the discharge lamps over a certain range through the adjustment of the operating frequency.

An advantageous embodiment of a circuit arrangement according to the invention is characterized in that the circuit arrangement is in addition provided with means of generating a signal which is a measure for a ratio between the luminous flux of the first discharge lamp and the luminous flux of the second discharge lamp, and for influencing the means for adjusting the operating frequency in dependence on said signal. It is possible through the use of this advantageous embodiment of a circuit arrangement according to the invention to maintain a certain ratio between the luminous fluxes of the discharge lamps during lamp operation in spite of changes, for example, in ambient parameters.

A further advantageous embodiment of a circuit arrangement according to the invention is characterized in that the circuit arrangement is in addition provided with means for adjusting the luminous flux of the light jointly radiated by the discharge lamps. It is possible by means of this further advantageous embodiment of a circuit arrangement according to the invention to adjust not only the ratio between the luminous fluxes of the discharge lamps but also the total luminous flux. The means for adjusting the luminous flux of the light join fly radiated by the discharge lamps may comprise, for example, means for adjusting the duty cycle of the control signal generated by the control circuit, or means for adjusting the amplitude of the supply voltage.

Embodiments of the circuit arrangement according to the invention are shown in the drawing.

DESCRIPTION OF THE PREFERRED EMBODIMENT

Figure 1:
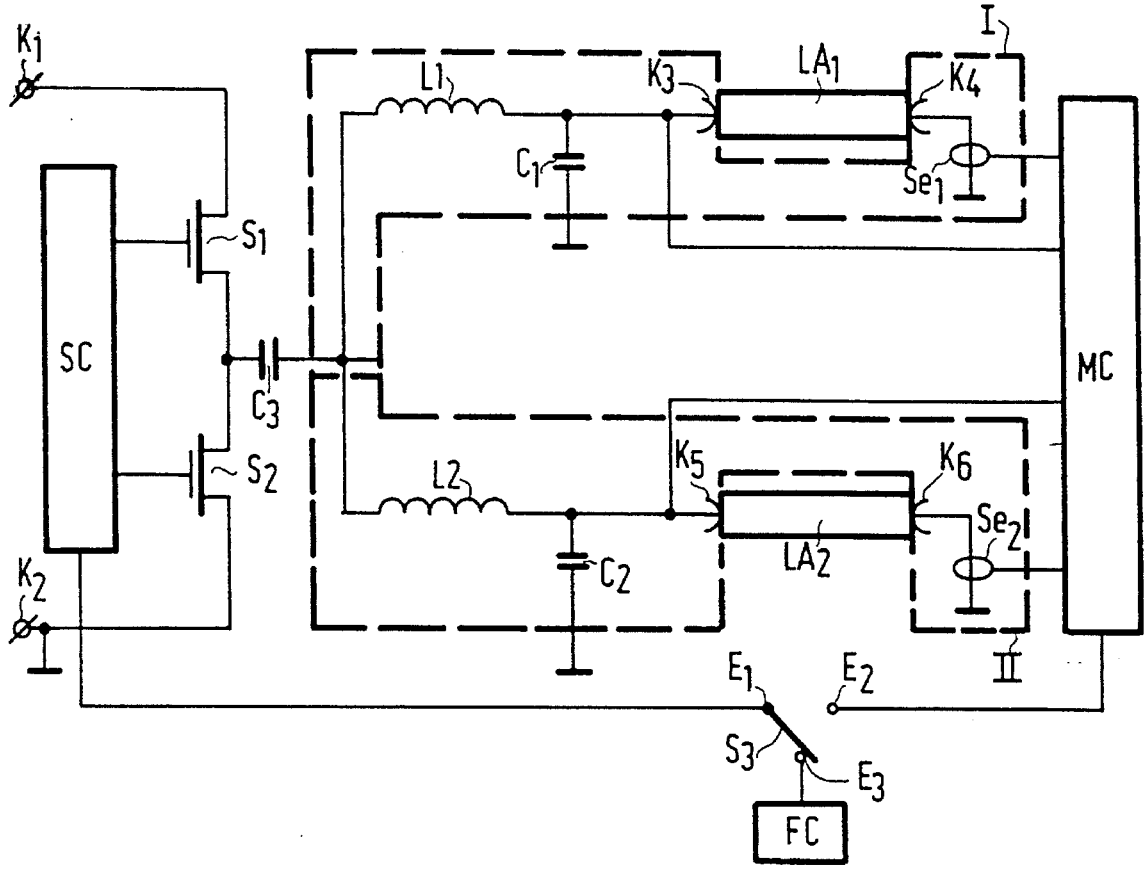
FIG. 1 is a circuit diagram of an embodiment of a circuit arrangement according to the invention.

In FIG. 1, K1 and K2 are input terminals for connection to a supply voltage source, in the embodiment shown a DC voltage source. Input terminals K1 and K2 are interconnected by a series circuit of switching element S1 and switching element S2, which in this embodiment form the switching means for generating a high-frequency voltage from a supply voltage delivered by the supply voltage source. Control electrodes of the switching elements S1 and S2 are connected to respective outputs of control circuit SC for generating a control signal for rendering the switching elements alternatively conducting and non-conducting at a high frequency.

A common junction point of the switching elements S1 and S2 is connected to a first side of a capacitor C3. A further side of capacitor C3 is connected to a first side of coil L1. A further side of coil L1 is connected to terminal K3 and to a first side of capacitor C1. A further side of capacitor C1 is connected to input terminal K2. Terminal K3 is connected to terminal K4 via discharge lamp La1. Terminal K4 is connected to input terminal K2. Coil L1, capacitor C1, terminals K3 and K4 for holding a discharge lamp, and input terminal K2 in this embodiment form the first load branch (I). Coil L1 and capacitor C1 form the first inductive and the first capacitive means, respectively, which form part of the first load branch. The further side of capacitor C3 is also connected to a first side of coil L2. A further side of coil L2 is connected to terminal K5 and to a first side of capacitor C2. A further side of capacitor C2 is connected to input terminal K2. Terminal K5 is connected to terminal K6 via discharge lamp La2. Terminal K6 is connected to input terminal K2. Coil L2, capacitor C2, terminals K5 and K6 for holding a discharge lamp, and input terminal K2 in this embodiment form a second load branch (II).

Capacitor C3 serves to prevent a direct current flowing through one of the load branches. The capacitance of capacitor C3 is so chosen that the resonance frequencies of the first and second load branches are scarcely influenced by capacitor C3. Coil L2 and capacitor C2 form the inductive and the capacitive means, respectively, of the second load branch. Terminal K3 and terminal K5 are connected to respective inputs of circuit portion MC. The two load branches are also coupled to respective inputs of the circuit portion MC via current sensors Se1 and Se2. The circuit portion MC in this embodiment together with sensors Se1 and Se2 form a circuit for generating a signal which is a measure of a ratio between the luminous flux of the first discharge lamp and the luminous flux of the second discharge lamp, and for influencing the means for adjusting the operating frequency in dependence on this signal. For this purpose, an output of circuit portion MC is connected to an input of control circuit SC via two main electrodes E1 and E2 of switching element S3. An output of circuit portion FC is connected to a third main electrode E3 of switching element S3. Circuit portion FC manually generating a signal to influence the circuit for adjusting the operating frequency. The circuit for adjusting the operating frequency in this embodiment form part of the control circuit SC.

The operation of the circuit arrangement shown in FIG. 1 is as follows.

When the input terminals K1 and K2 are connected to a DC voltage source, the control circuit SC renders the two switching elements S1 and S2 conducting and non-conducting at a high frequency switching rate. As a result of this, a substantially square-wave high-frequency voltage is present at the common junction point of the two switching elements. Owing to this substantially square-wave high-frequency voltage, a high-frequency current flows in the two load branches. Signals are present at the inputs of circuit portion MC which are a measure of amplitudes of the currents in the load branches and the voltages across the first and the second discharge lamp. Circuit portion MC generates a signal which is a measure of the ratio between the power consumed by the first discharge lamp and the power consumed by the second discharge lamp by means of these signals present at the inputs. This signal is also a measure of the difference between the luminous flux of the first discharge lamp and the luminous flux of the second discharge lamp.

When the switching element S3 is in a first state in which main electrode El is connected to main electrode E2, the output of circuit portion MC is connected to the input of control circuit SC, and the control circuit SC adjusts the frequency of the high-frequency voltage in dependence on the signal generated by circuit portion MC. In this manner, for example, it can be achieved that the luminous fluxes of the two discharge lamps are substantially equal. It is alternatively possible, however, to maintain a ratio between the luminous fluxes of the discharge lamps at a substantially constant level.

When the switching element S3 is in a second state in which main electrode E1 is connected to main electrode E3, it is possible to adjust the operating frequency manually by means of the circuit portion FC. If the colour point of the light radiated by discharge lamp La1 differs from the colour point of the light radiated by discharge lamp La2, this manual adjustment of the operating frequency of the high-frequency voltage offers the possibility of adjusting the colour point of the light radiated jointly by the two discharge lamps over a certain range. A change in the operating frequency in fact causes the luminous flux of one of the discharge lamps to increase and the luminous flux of the other lamp to decrease. It is also possible with switching element S3 in the second state, when one of the discharge lamps La1 or La2 is absent or defective, to operate the remaining, correct discharge lamp by means of the circuit arrangement. The luminous flux of the discharge lamp can be adjusted in that the frequency of the high-frequency voltage is adjusted via the circuit portion FC. The state of the switching element S3 can be set manually. It is also possible to influence the state of the switching element S3 by means not shown in FIG. 1, for example, in dependence on the signal generated by circuit portion MC (if one of the discharge lamps La1 or La2 is absent or defective, the signal generated by the circuit portion MC assumes comparatively low or comparatively high values).

Irrespective of the state of switching element S3, the luminous fluxes of the discharge lamp(s) operated by means of the circuit arrangement can be influenced through adjustment of the amplitude of the DC voltage present between input terminals K1 and K2, or through adjustment of the duty cycle of the control signal generated by control circuit SC.

Figure 2:
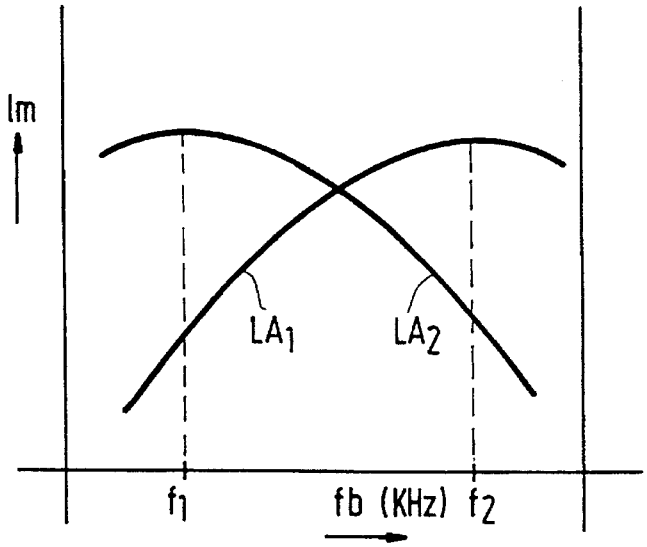
FIG. 2 is a graph showing the luminous fluxes of discharge lamps operated by a circuit arrangement as shown in FIG. 1 as a function of the operating frequency.

FIG. 2 shows the luminous flux in lumens plotted on the vertical axis. The operating frequency in kHz is plotted on the horizontal axis. The curves indicated with La1 and La2 show the respective luminous fluxes of discharge lamps La1 and La2 as a function of the frequency of the high-frequency voltage. It is apparent that each of the two curves has a respective maximum. These maxima correspond to the resonance frequencies of the first and second load branches. These frequencies have been indicated with f1 and f2, respectively, in FIG. 2. The adjustment range of the operating frequency lies between f1 and f2.

In a practical/realization of the embodiment of a circuit arrangement according to the invention as shown in FIG. 1, L1, L2, C1 and C2 were dimensioned as follows:

L1=1,9 mH

C1=13 nF

L2=1,8 mH

C2=12 nF

When low-pressure mercury discharge lamps of the TLD type with a power rating of 50 W are operated by means of this practical realization, the resonance frequencies of the load branches are 32 and 34 kHz, respectively. It was found to be. possible to keep the luminous fluxes of the low-pressure mercury discharge lamps substantially equal, even when the luminous fluxes of the low-pressure mercury discharge lamps were set for approximately 1% of their nominal value.

In a further practical realization of the embodiment of a circuit arrangement according to the invention as shown in FIG. 1, L1, L2, C1 and C2 were so dimensioned that the resonance frequencies of the load branches were 32 kHz and 45 kHz, respectively. Low-pressure mercury discharge lamps with a power rating of approximately 50 W and with different colour points were operated by means of this further practical embodiment. It was found that the colour point of the light radiated jointly by the two low-pressure mercury discharge lamps could be adjusted over a considerable range through adjustment of the operating frequency.

We claim:

1. A circuit arrangement for operating at least two discharge lamps, comprising:

input terminals for connection to a supply voltage source, switching means coupled to the input terminals for generating a high frequency voltage from a supply voltage delivered by the supply voltage source, a control circuit for generating a high frequency signal for rendering the switching means alternately conducting and non-conducting at a high frequency, a first load branch provided with two ends which are coupled to the switching means, including first inductive means, first capacitive means, and terminals for accommodating a first discharge lamp, and having a first resonance frequency, and a second load branch provided with two ends which are coupled to the switching means, including second inductive means, second capacitive means, and terminals for accommodating a second discharge lamp, and having a second resonance frequency, characterized in that:

the first resonance frequency is sufficiently different from the second resonance frequency such that, upon operation of the ballast at the first resonance frequency the luminous flux of the first discharge lamp is greater than the luminous flux of the second discharge lamp, and upon operation of the ballast at the second resonance frequency the luminous flux of the second discharge lamp is greater than the luminous flux of the first discharge lamp, the frequency of the high frequency voltage is higher than the lower of the first and second resonance frequencies and lower than the higher of the first and second resonance frequencies, and the circuit arrangement comprises means for adjusting the frequency of the high frequency voltage in order to adjust the relative luminous flux of the first discharge lamp with respect to the luminous flux of the second discharge lamp.

2. A circuit arrangement for operating at least two discharge lamps, comprising:

input terminals for connection to a supply voltage source, switching means coupled to the input terminals for generating a high frequency voltage from a supply voltage delivered by the supply voltage source, a control circuit for generating a high frequency signal for rendering the switching means alternately conducting and non-conducting at a high frequency, a first load branch provided with two ends which are coupled to the switching means, including first inductive means, first capacitive means, and terminals for accommodating a first discharge lamp, and having a first resonance frequency, and a second load branch provided with two ends which are coupled to the switching means, including second inductive means, second capacitive means, and terminals for accommodating a second discharge lamp, and having a second resonance frequency, characterized in that:

the resonance frequency of the first load branch is different from the resonance frequency of the second load branch, the frequency of the high frequency voltage is higher than the lower of the first and second resonance frequencies and lower than the higher of the first and second resonance frequencies, and the circuit arrangement comprises:

means for generating a signal which is a measure of a ratio between the luminous flux of the first discharge lamp and the luminous flux of the second discharge lamp, means for adjusting the frequency of the high frequency voltage, and means for influencing said means for adjusting in dependence on said signal, thereby adjusting the relative luminous flux of the first discharge lamp with respect to the luminous flux of the second discharge lamp.

3. A circuit arrangement for operating at least two discharge lamps, comprising:

input terminals for connection to a supply voltage source, switching means coupled to the input terminals for generating a high frequency voltage from a supply voltage delivered by the supply voltage source, a control circuit for generating a high frequency signal for rendering the switching means alternately conducting and non-conducting at a high frequency, a first load branch provided with two ends which are coupled to the switching means, including first inductive means, first capacitive means, and terminals for accommodating a first discharge lamp, and having a first resonance frequency, and a second load branch provided with two ends which are coupled to the switching means, including second inductive means, second capacitive means, and terminals for accommodating a second discharge lamp, and having a second resonance frequency, characterized in that:

the resonance frequency of the first load branch is different from the resonance frequency of the second load branch, the frequency of the high frequency voltage is higher than the lower of the first and second resonance frequencies and lower than the higher of the first and second resonance frequencies, and the circuit arrangement comprises:

means for adjusting the luminous flux of the light jointly radiated by the discharge lamps, and means for adjusting the frequency of the high frequency voltage in order to adjust the relative luminous flux of the first discharge lamp with respect to the luminous flux of the second discharge lamp.

4. A circuit arrangement as claimed in claim 3, further comprising means for generating a signal which is a measure of a ratio between the luminous flux of the first discharge lamp and the luminous flux of the second discharge lamp and means for influencing said means for adjusting in dependence on said signal, thereby adjusting the relative luminous flux of the first discharge lamp with respect to the luminous flux of the second discharge lamp.

* * * * *